US005099625A

United States Patent [19]

Staudt

[11] Patent Number: 5,099,625

[45] Date of Patent: Mar. 31, 1992

[54] PARTITION WALL FOR OPENINGS IN BUILDING SHELLS, FORMING FIRE PROOF SECTIONS

[76] Inventor: Gerhard Staudt, Burgermeister-Elsasser-Haus, D-7107 Bad Wimpfen, Fed. Rep. of Germany

[21] Appl. No.: 427,857

[22] PCT Filed: Mar. 22, 1988

[86] PCT No.: PCT/DE88/00178

§ 371 Date: Sep. 22, 1988

§ 102(e) Date: Sep. 22, 1988

[87] PCT Pub. No.: WO88/07611

PCT Pub. Date: Oct. 6, 1988

[30] Foreign Application Priority Data

Mar. 24, 1987 [DE] Fed. Rep. of Germany ..... 3709654

[51] Int. Cl.[5] ..... E04C 2/00

[52] U.S. Cl. ..... 52/232; 52/220; 52/221

[58] Field of Search ..... 52/220, 221, 232

[56] References Cited

U.S. PATENT DOCUMENTS

| | | | |
|---|---|---|---|
| 3,659,247 | 4/1972 | Chaney et al. | 52/22 D X |
| 4,232,494 | 11/1981 | Bauch et al. | 52/220 |
| 4,302,914 | 12/1981 | Fermvik et al. | 52/221 |
| 4,337,603 | 7/1982 | Davidson | 52/220 |

FOREIGN PATENT DOCUMENTS

| | | | |
|---|---|---|---|
| 40291 | 11/1957 | Poland | 52/220 |

OTHER PUBLICATIONS

Copy of two pages from a German technical dictionary entitled, "Worterbuch der industrielle Technik Baud II", Ernst, Brandstetter Verlag 7985.051014009

*Primary Examiner*—David A. Scherbel
*Assistant Examiner*—Wynn Wood
*Attorney, Agent, or Firm*—Collard, Roe & Galgano

[57] ABSTRACT

Process for fitting partititon walls or ceilings to openings in building shells, forming fireproof sections, using fireproofing cushions (12), removable from the openings. Said process is characterized by the fact that square or cuboid fireproofing cushions (12) are used, and are fitted into the relavent opening (11) in the wall or ceiling of the building shell during construction.

5 Claims, 4 Drawing Sheets

FIG. 1
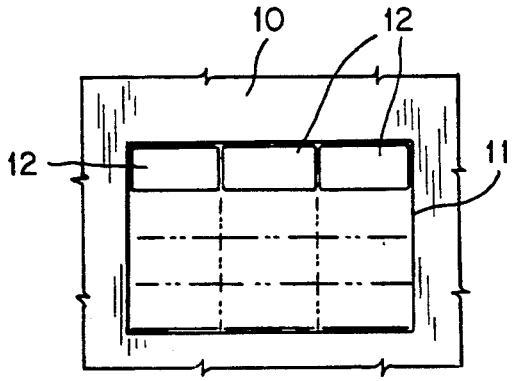
FIG. 2
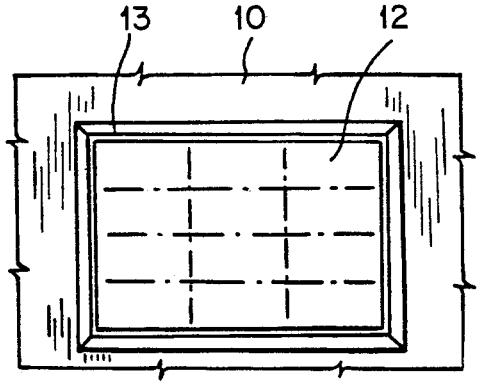
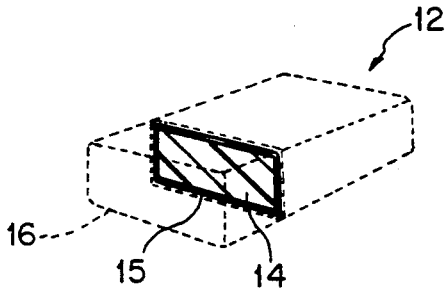
FIG. 3
FIG. 4
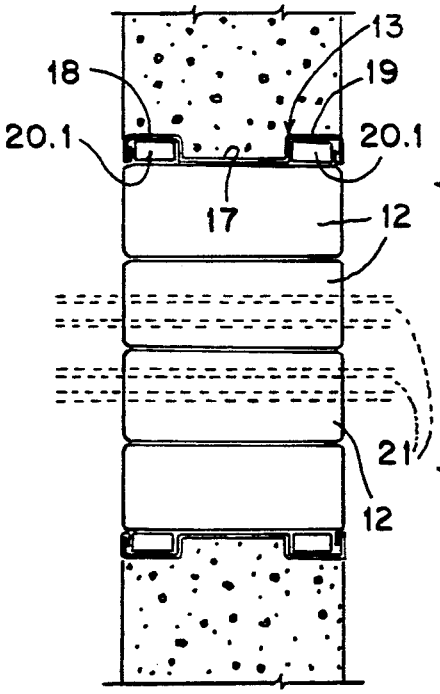
FIG. 5
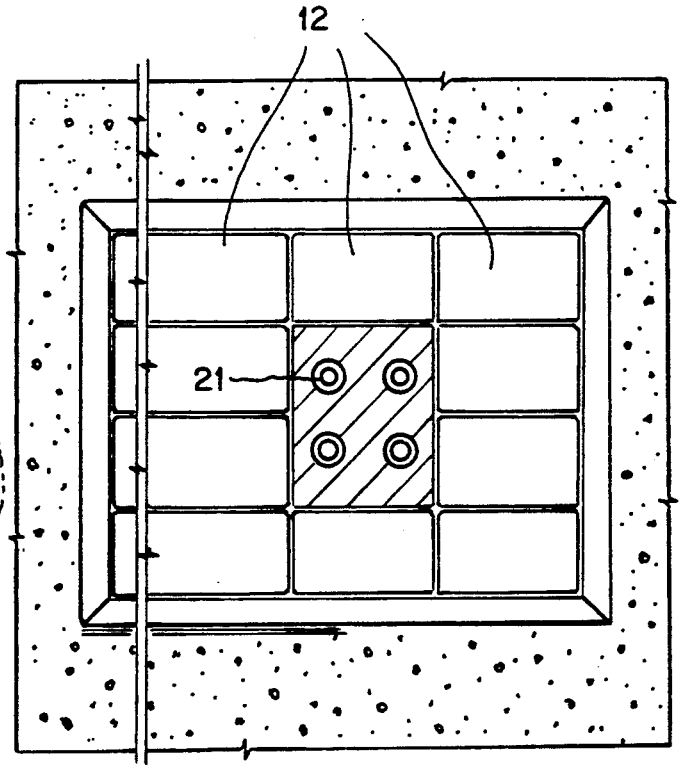

PARTITION WALL FOR OPENINGS IN BUILDING SHELLS, FORMING FIRE PROOF SECTIONS

TECHNICAL FIELD

The invention relates to a method of partitioning carcase openings in structural walls or ceilings defining fire sections. The invention also relates to a fire-protection cushion suitable for this method. Furthermore, the invention relates to a partition element likewise suitable for this method and prefabricated as a finished part. Finally, the invention also relates to a case, adapted to this method, for producing the soffit of a carcase opening to be partitioned in a structural wall or ceiling defining a fire section.

On accound of building laws and regulations, larger buildings must be subdivided into fire sections. Here, there is the problem that electric cables and supply lines have to be passed through these fire sections and thus the individual fire sections inside the building are connected to one another via these cables and supply lines. But openings in the ceilings and walls defining fire sections are inadmissible for reasons of fire protection. The supply lines and cables and also other pipes to be passed through may only be passed through the walls and ceilings if there is no danger of fire spreading as a result of this or if special precautions have been taken to prevent the spread of fire.

In the event of fire, there is the risk of the insulation on the cables and supply lines as well as on pipes spreading the fire from one room to the other even if it is fire-resistant. A further disadvantage in this respect is that, if electrical or other supply lines are on fire, poisonous combustion gases can be released.

The object of partitioning then is to avoid the spread of fire and smoke from one room into another adjacent room. For technical reasons relating to fire, this partition is a wall or ceiling part, which means that it must have the fire resistance of the wall or ceiling. Thus the partition, just like the rest of the wall or ceiling, must withstand the action of a fire lasting, for example, for 90 or 180 minutes; the increase in temperature relative to the initial temperature must not be greater than 140 degrees on average, but at no measuring point greater than 180 degrees, outside the fire space. Furthermore, no ignitable gases and no smoke must pass through the partitioning.

In buildings where there is a great deal of technical finishing operations, the fire protection regulations, after the end of the carcasing phase, must be observed during the finishing with electric cables and other supply lines. This means that structural parts, such as walls or ceilings, defining fire sections must be designed to be fire-resistant during the finishing phase. During a finishing phase in a plurality of finishing stages it thus has to be ensured that even openings which are only partly laid with supply lines are fire-resistant in their respective finished state; on the other hand, it also has to be ensured that subsequent installation can be carried out, during which further supply lines are to be subsequently passed through the apertures only partly laid with supply lines.

PRIOR ART

In practice, it is known to partition in a fire-resistant manner the apertures present in a carcase in ceilings and walls only during the finishing phase of this building.

This is regularly done in a quite expensive manner. Thus so-called partitions have to be made and assembled for apertures in ceilings or walls which are less than 15 cm thick.

The soffits of the openings can also be filled with sheet-steel cases. These cases are adapted in shape to the soffit surface and thus have a planar configuration in the area of the soffit. To prevent the partitioning material, after installation in an aperture, from falling out of this opening again, profiled parts projecting into the opening must be attached either to the soffit of the carcase opening or to the case part representing the supply line. This subsequent installation turns out to be quite difficult, since these parts must not be welded on, for example, in communication facilities, computing centers or the like and there is not sufficient space for the screwing and drilling work necessary in other types of fastening.

To subsequently fill carcase openings, fire-protection cushions are known which can be inserted into the openings in such a way as to be removable again. These cushions have a filling of non-combustible mineral wool and are covered with a non-combustible textile glass material which is impregnated with insulating-layer developers which react to heat in the event of fire. The fillings can also be made of other materials which in the event of fire change into a firm ceramic compound. The cushions have a plastically deformable configuration, since the filling is present in the form of numerous small particles in the envelope of textile glass material surrounding it. On account of their considerable deformability, the risk of cushions of this type falling unintentionally out of the opening is relatively high. The degree of utilization [sic], on account of the compression which takes place during installation and also the time needed to fill the carcase opening with these cushions, is also quite considerable and can scarcely be justified economically.

DE-A 3,037,393 discloses a fire-protection device for an encapsulated cable lead-through through building walls. Narrow strips of hydrous sodium silicate combined to form small packets are used as fire-protection bags, which strips are provided with small quantities of organic additions and are reinforced by glass fibres and/or glass fabrics and are coated with epoxy resin at least on the upper side and underside. In this arrangement, the strip packets are sheathed with a film and sit in a U-shaped channel provided with a lid. Furthermore, this channel is closed at its two front ends by a seal. At temperatures of more than 100 degrees celsius, the strips expand and thereby form a non-separable heat-resistant expanded coating. Owing to the fact this fire-protection device only becomes effective at temperatures in the interior of the partitioning of over 100 degrees celsius and thus only with a time delay, the fire-protection device must be sealed at the front end with a smokeproof and fireproof asbestos expanded material. These seals at the front ends must bear tightly against the supply lines passed through the partitioning. This means that the fire-protection device cannot be fitted as a whole into the relevant wall or ceiling during the making of the carcase opening.

DESCRIPTION OF THE INVENTION

The object of the invention is to find a partitioning method for the stated purpose and to design fire-partitioning elements, specially adapted to this partitioning method, in such a way that the disadvantages, shown above, of the known methods or the known fire partitioning elements are avoided and an economically justifiable partitioning which is nonetheless satisfactory as regards fire protection is made possible.

In the method according to the invention for partitioning carcase openings in structural walls or ceilings defining fire sections, this is achieved, using using fire-protection cushions which are inserted into the openings in such a way as to be removable again, by the fire-protection cushions being inserted into the relevant structural wall or ceiling even during the making of the carcase openings. In precast concrete elements in which there are to be openings, fire-protection cushions are thus used even during the production of the precast units instead of the hitherto conventional plastic filler bodies to be used once. Consequently, the plastic filler bodies which cannot be reused as well as the expenditure required in connection with the subsequent partitioning are saved. In the making of openings in masonry walls, the expenditure required to make and partition appropriate openings can likewise be reduced. The expenditure which results from the embedding of the fire-protection cushions is scarcely greater than in the conventional method for making openings. The saving is made due to the fact that the subsequent expenditure in connection with the partitioning of ready made carcase openings does not arise.

A fire-protection cushion which is especially suitable for this method is characterized in that it has an outer envelope of non-combustible textile glass material in which there is a filling of non-combustible mineral wool, in that the filling consists of a single body in the shape of a parallelepiped or a cube, in that the body is made of non-compressible mineral wool to which very small proportions of organic bonding agents are added; and furthermore the outer envelope of this fire-protection cushion is surrounded by a further envelope of non-combustible textile glass material, and envelope and filling are designed to be non-deformable under the effect of fire. The organic bonding agent ensures that the mineral wool can be provided in the desired shape of a parallelepiped or a cube. The invention, in a surprising manner, thus makes use of the knowledge that very small proportions of organic bonding agents in connection with these fire-protection cushions are not harmful; thus these fire-protection cushions do not lose their strength and form even under the effect of fire, as official material tests according to DIN 4102 at material-testing institutes have shown.

A fire-protection cushion of this type ensures that the same is fully adapted, and to a certain extent elastically, to the soffit of a carcase opening or to further cushions. In addition, the interaction of the two envelopes ensures the compression required in practice as well as the elasticity and deformability of the fire-protection cushions.

In an advantageous manner, the edges of this body are approximately between 5 cm and 50 cm long. On account of this form, a fire-protection cushion of this type is suitable for both the very rapid subsequent partitioning of already existing carcase openings and also, in the making of openings to be partitioned, as a "masonry body" or "filler body" during the making of the relevant carcase openings. The edged form of the fire-protection cushion makes possible rectilinear planar adaption and thereby also favourable preconditions for the compression of the cushions both relative to one another and relative to the soffits of carcase openings; in addition, the edged form of the cushion prevents the cushion from falling or slipping unintentionally out of the opening.

In order to design all parts of fire-protection cushions of this type so as to be fire-resistant, the seams of the envelope are made with threads of 100 percent, non-combustible textile glass material.

In openings which are lined with or have to be lined with a sheet-steel case, in order to make it possible in a simple manner for these openings to be partitioned even during the making of the openings with fire protection cushions which are removable again, a partition element, according to a further, very essential feature of the invention, is specified as a finished part which consists of a surrounding case as well as fire-protection cushions which are present in the area enclosed by the case. In this arrangement, the fire-protection cushions bear closely against one another inside the case. A partition element of this type can be used as a finished part, as it were as a filler body, in the making of carcase openings. Thus it is now also possible in the case of partitioning measures to profitably utilize the knowledge that the prefabrication of structural parts in fabrication areas is more economical than the subsequent production of such structural parts on a building site, which also qualitatively benefits the partitioning measure, and that in addition the making of the carcase opening is substantially facilitated by the use of a finished filler body.

Since such partitioning measures using fire-protection cushions are not, from a technical point of view as regards fire, considered to be solid partitions and thus fixed structural bodies, mechanical safety features with which fire-protection cushions can be prevented from being pushed more or less unintentionally out of partitioned openings are advantageous. This can be made possible in a simple and in addition visually pleasing manner by a cover for the fire-protection cushions being arranged on at least one free front end of the cushions, which cover can be detachably fixed to the case. The detachability is necessary to enable additional supply lines to be passed through the openings later without considerable effort.

When additional supply lines are passed through the opening, not all of the spaces still available in the opening are generally required. Therefore not all fire-protection cushions present in the opening need to be removed. This means that the cover also does not need to be removed completely from the front end of the cushions. These requirements can be met by a partition element which is characterized in that the cover has channel-like shaped portions which subdivide the cover into individual panels, the shaped portions representing material reductions in the cover in such a way that the individual panels on the cover can be selectively broken out. Thus panels can be selectively released from the cover in the number and at the locations which have to be available to pass supply lines through the corresponding carcase opening. Of course, the fire-protection cushions originally present in this area have to be released from the opening. The intermediate spaces inside the opening which are present between the supply lines and fire-protection cushions surrounding them are to be filled with partioning compounds such as, e.g., the so-called VAM compound to be found on the market.

From the manufacturing point of view, a cover of this type can be realized in a favourable manner with a metallic plate about 1.5 mm thick or a plastic plate about 3 mm thick.

In a further development of the invention, the case preferably to be used in the method according to the invention and in connection with the above partition element according to the invention and intended for producing the soffit of a carcase opening to be partitioned in a structural wall or ceiling defining a fire section is characterized in that a projecting part projects away from the outer side of the part of the case forming the soffit. This projecting part, which, according to one proposal, can be a leg of an angled profile, the other leg of this angled profile then being fixed to the case, provides for a secure hold of the case in the corresponding wall or ceiling. Provided this projecting part is not designed as a solid profile but with an outwardly or inwardly curved portion—in particular like a formed profile—the outwardly curved portion ensures that on the one hand the connection between the case and the structural part or the cushion located on the other side can be made in a positive-locking manner and that on the other hand the longitudinal extent of the case can be extended transversely through the opening: a distance increased by the size of the outwardly curved portion is available to the case, heated up considerably in the event of fire, for dissipating the high temperature transversely through the building. In addition, the flexural strength of the case is considerably increased by the above measures. In suitable cases, even the provision of lintels in the making of openings in masonry walls can thus be dispensed with.

To increase the fire resistance, the outwardly curved portion in the case can be of such dimensions that a fire-protection cushion just finds space in it.

According to a further feature of the invention, an approximately right-angled edging is present at at least one longitudinal side of the case, which edging particularly protrudes into the opening area enclosed by the case. This edging can then be used in an advantageous manner both to fix a cover laterally covering the opening area and as a bearing surface for partitioning material located in the opening area such as, e.g., the fire-protection cushions. In addition, the edging also has the advantage that additional compression of all the fire-protection cushions present can be achieved at the surrounding opening margin by means of so-called adaption cushions.

A case of this type can be used in particular as a ceiling case and thus for partitioning a carcase opening in a structural ceiling defining a fire section when at least three hollow profiles are fixed to the inside of the soffit side of this case, when, furthermore, the longitudinal sides of these hollow profiles are orientated perpendicularly to the opening plane enclosed by the case, when, in addition, the hollow profiles have an internal thread into which a bar-shaped member having an external thread can each be screwed in to different extents, and when, finally, the members are fixed to a frame surrounding the case at a distance and in the form of a collar and the frame has an inner stepped portion on which a cover plate closing the opening area can be mounted. The case thus still serves to accommodate partitioning material such as, e.g., the fire-protection cushions. The hollow profiles, which in particular are fixed to the inner side of each corner of the case, serve to support the cover plate, which covers from the top the carcase opening closed with partitioning material, and also serve as a stop strip which is vertically adjustable with respect to the case and thus the bare ceiling and can thus be adjusted to the desired level of the finished flooring.

Further advantages of the invention are revealed in the features further specified in the claims.

BRIEF DESCRIPTION OF THE DRAWING

The invention is described and explained in greater detail below with reference to the exemplary embodiments shown in the drawing. The features revealed in the description and the drawing can be used individually by themselves or in a plurality of any combination in other embodiments of the invention. In the drawing:

FIG. 1 shows a view of a carcase opening which is filled with individual partitioning bodies, FIG. 2 shows a representation according to FIG. 1 in which the soffit of the carcase opening is lined with a sheet-steel case, FIG. 3 shows a perspective view of a schematically represented, partly sectioned partitioning body in the form of a fire-protection cushion, FIG. 4 shows a longitudinal section through a wall opening which is filled with the fire-protection cushion shown in FIG. 3 and through which supply lines are to be passed, FIG. 5 shows a view of the wall opening shown in FIG. 4 through which the supply lines are to be passed in a sectional area, there being fire-protection cushions in the rest of the opening area, and the space between the supply lines and the fire-protection cushion being filled by fixed partitioning bodies.

METHODS OF EMBODYING THE INVENTION

Figure 6:
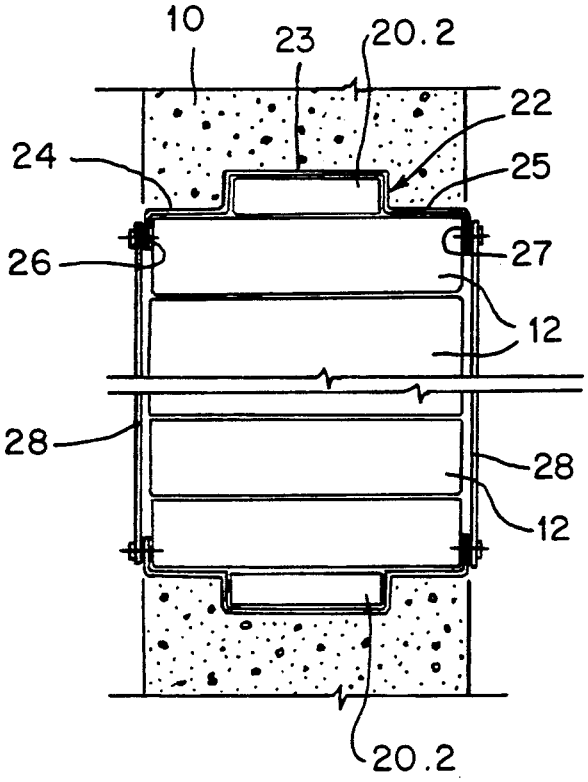
FIG. 6 shows a longitudinal section through a wall opening, the opening being filled with fire-protection cushions and being closed with a cover at each of the front ends, the steel case used as a soffit being designed in a different way to the case shown in FIG. 4.

There is an aperture 11 in a wall 10. This wall aperture 11 is filled with fire-protection cushions 12, of which only three, drawn in solid lines, are shown. The cushions 12 are roughly in the shape of a parallelepiped (FIG. 3).

Whereas the cushions 12 in the representation according to FIG. 1 bear directly against the soffit of the wall 10, in the representation according to FIG. 2 the soffit of the wall 10 is formed by a case 13 so that the cushions 12 adjoining the soffit come into direct contact with the case 13 and not with the wall 10.

Each cushion 12 has an inner body 14 which is in the shape of a parallelepiped or a cube. This body 14 is surrounded by an inner envelope 15 which in turn is completely surrounded by a further, outer envelope 16. Both the two envelopes 15, 16 and also the body 14 are made of non-combustible material. The edged form of the body 14 enables bodies of this type to be readily stacked one above the other and thus enables such fire-protection cushions to be used, as it were, as "masonry stones". The two envelopes 15, 16, in a "masonry stone" of this type, enable the same to have a certain elasticity and resilience so that it can be fitted into an aperture 11 with a movable seating in the manner of a press fit directly adjoining the wall or indirectly adjoining the same via a case. In addition, the presence of a second envelope has the substantial advantage that, when a corresponding cushion is walled in or concreted in directly, only its one outer envelope forms a firm connection with the masonry or concrete, while the other, inner envelope remains elastic.

The case 13 has a centre, U-shaped part 17 and, in each case adjoining the U-shaped part 17, outer U-shaped parts 18 and 19 respectively. Sitting closely in each of the outer U-shaped parts 18, 19 is a non-combustible cushion 20.1 which in material corresponds to the cushion 12. Adjoining the U-shaped part 17 of the case 13 are the cushions 12 which are fitted in the manner of a press fit in the frame-shaped case 13. In this arrangement, the cushions are as long as the wall 10 is thick. In perpendicular walls it is thus virtually impossible for the cushions 12 to fall unintentionally out of the aperture 11. If supply lines 21 are to be passed through the aperture later, the appropriate number of fire-protection cushions are to be removed from the aperture at the appropriate locations. In their place, after the supply lines 21 have been laid, the intermediate space present between the supply lines 21 and the cushions still present is filled with one of the known, hardenable partitioning compounds. Both the area of the partitioning compound as well as the area filled with fire-protection cushions are thus designed to be fire-resistant by themselves and as a whole. On account of their special form and design, it is most simple to arrange for supply lines to be subsequently passed through an aperture.

The case 22 shown in FIG. 6 likewise has a centre, U-shaped part 23, adjoining which, in each case towards the outside, are angular parts 24 and 25 respectively. With the centre, U-shaped part 23, the case protrudes into the wall 10, as a result of which it is firmly seated in the same. Again present inside the case 22 are the cushions 12 stacked one above the other in a press fit, while a cushion 20.2 adapted in size is present in each of the centre, U-shaped parts 23.

The angled design of the cases in the area of the wall 10 results in a greater length of the case transversely to the wall, which, in the event of fire, helps the heat dissipation at the case, heated to a considerable degree, transversely through the wall so that, on the wall side remote from the fire, the permissible temperatures are not exceeded even at the metallic case.

The angular outer parts 24, 25 have a bend 26 and 27 respectively running in the wall plane. A plurality of plates 28 are screwed to the two frame parts of the case located opposite one another relative to the wall opening, which plates 28 cover the cushions 12 at the end faces on both sides of the wall. These plates 28 are not necessary to increase the fire resistance of the partitioned wall aperture; on the contrary, they serve to mechanically protect the fire-protection cushions from being more or less unintentionally pulled or pushed out of the opening.

Figure 7:
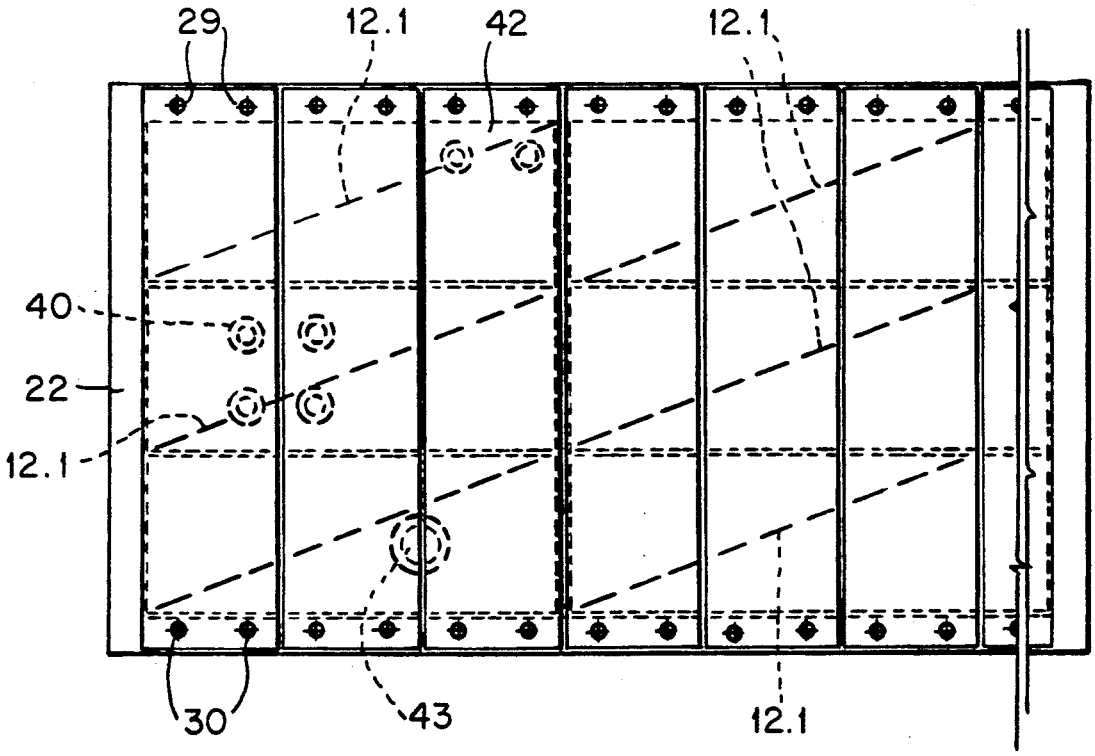
FIG. 7 shows a view of a masonry opening which is provided with the covers shown in FIG. 6 and through which supply lines are to be passed later at different locations.

FIG. 7 shows a plurality of plates 28 orientated side-by-side and parallel to one another, each of which is screwed via two screw connections 29, 30 each to opposite frame parts of the case—and in fact to their bends 26. In the representation according to FIG. 7, cushions 12.1 having edge dimensions 10 cm×30 cm×20 cm (length×width×depth) are present in the 20 cm deep wall aperture. The edge dimensions can vary within wide ranges so that any wall or ceiling openings can be filled with cushions of this type. Thus smaller outwardly curved portions in the area of the case, such as, for example, the centre or outer U-shaped parts 17, 18, 25 of the cases 13, 22, can readily be filled with cushions of this type.

Each of these plates 28 has channel-like recesses 31 or 32 whose cross-sectional form depends on the material of the plate 28; thus in a plate 28.1 made of a plastic material and having, for example, a thickness of 3 mm the channels 31 are deeper than the channels 32 in a plate 28.2 made of a metallic material. Both plates 28.1 and 28.2, on their narrow sides, each have two holes 33 and 34 respectively with which they can be screwed to a case outside the wall area.

The channels 31 and 32 run crosswise over the respective plate 28.1 and 28.2 but do not meet in the respective areas of intersection. Consequently, the areas of a plate which are bordered by the channels can easily be released individually from the plate, for example by being broken out of the plate. The webs 37.1 and 37.2 respectively which remain at the longitudinal sides 35, 36 of the plates 28.1, 28.2 when any panels are broken out ensure that, even after any panels of a plate 28.1 or 28.2 have been broken out, this plate 28.1 or 28.2 can remain screwed to a case by means of its holes 33 and 34 respectively.

Provided plates 28.1 and 28.2 of this type are to be used in connection with the face side covering of wall apertures which are not bordered by a case, the plates 28.1 and 28.2 can be screwed directly to the wall through their holes 33 and 34 respectively.

Figure 8:
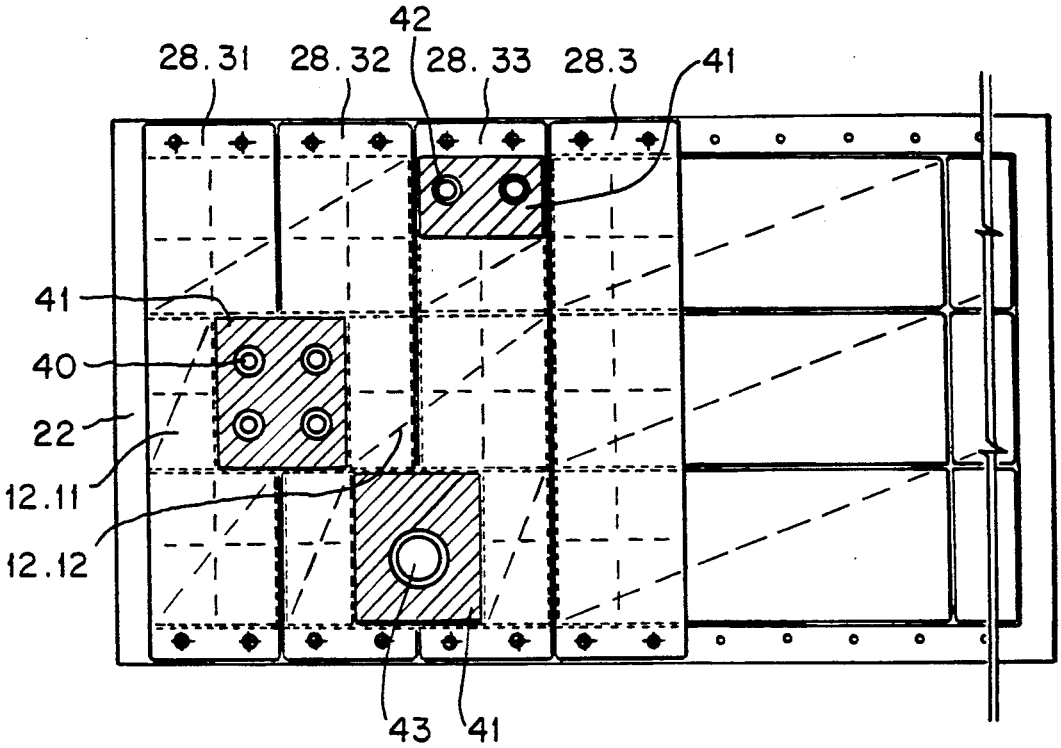
FIG. 8 shows a view of the opening shown in FIG. 7 with supply lines passed through it in sectional areas.
Figure 9:
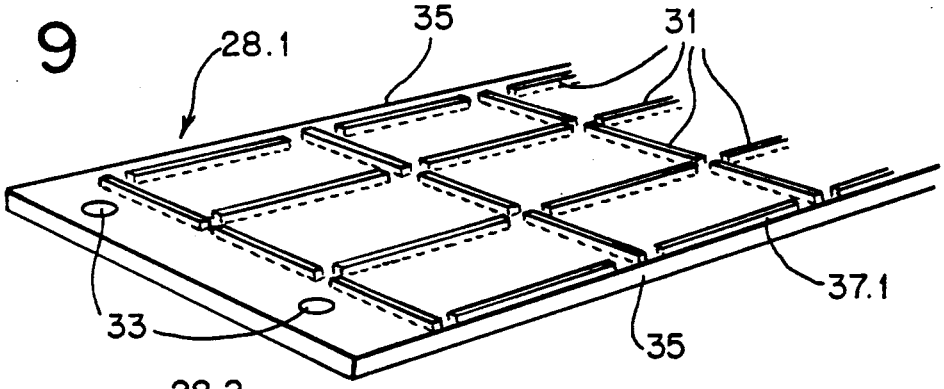
FIG. 9 shows a perspective representation of the cover used in FIGS. 6 and 7, which is made of a plastic material.
Figure 10:
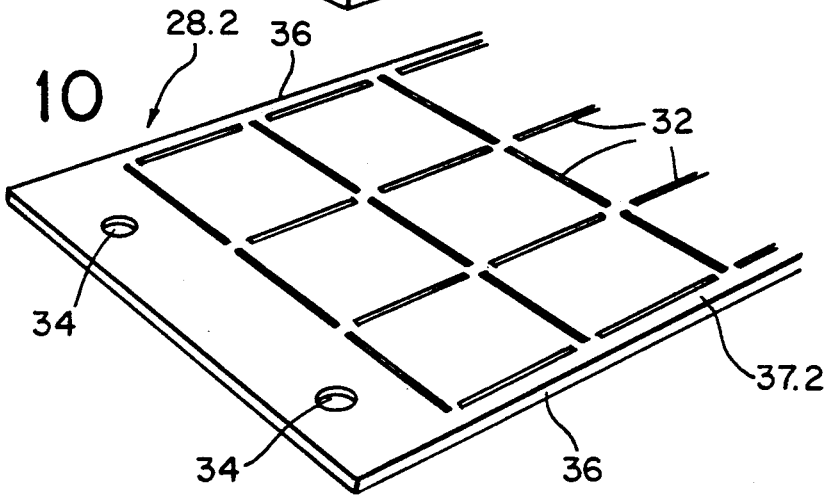
FIG. 10 shows a cover similar to that in FIG. 9, but unlike the cover in FIG. 9 it is made of a metallic material.
Figure 11:
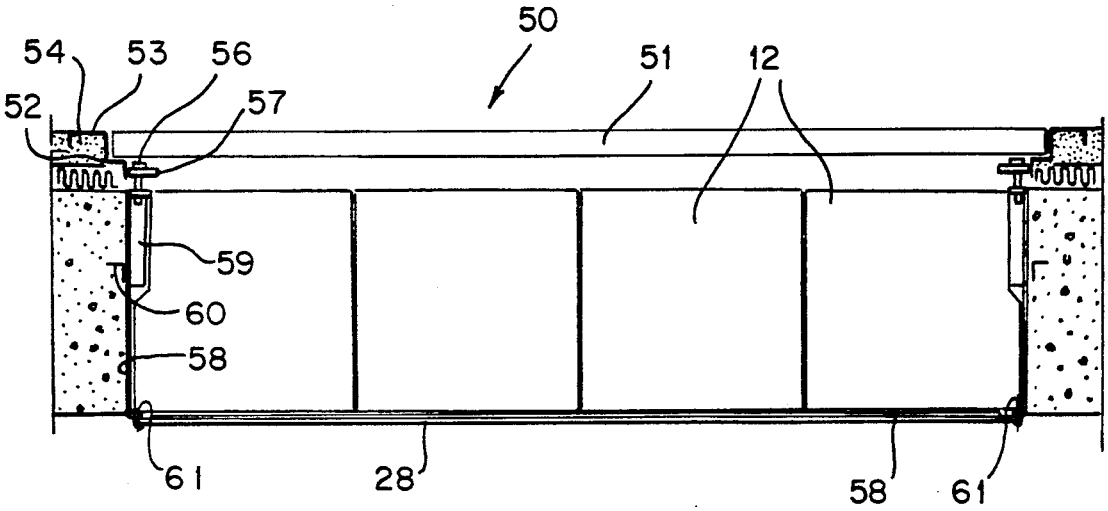
FIG. 11 shows a longitudinal section through a ceiling opening which is filled with fire-protection cushions.

FIG. 8 shows plates 28.1 [sic] from which either no panels at all are released or panels are released at different locations. In the plates 28.3, unlike the plates 28.1 and 28.2, there are only two panels, and not three, present side by side over the width of the plate in each case in parallel alignment with the holes. The number of channels present in a plate is largely optional and depends, inter alia, on the size of the plates. Thus the left hand plate 28.31 has two panels missing in the centre, right hand area, while the plate 28.32 next to it has two panels missing in the left hand, centre area. In addition, two panels have been released from the plate 28.32 in the right hand, lower area. The third plate 28.33 has two panels missing in both the upper area and the lower, left hand area. The fourth plate 28.3 is complete.

In the centre area of the plates 28.31, 28.32 and 28.33, the cushion 12.1 (FIG. 7) originally present there, after this plate has been detached from the case 22, has been removed and in its place a cushion 12.11 (10 cm×5 cm×20 cm) has been inserted on the left and a cushion 12.12 (10 cm×15 cm×20 cm) has been inserted on the right, supply lines 40 being passed between these cushions through the opening in the building. The space present between the supply lines 40 and the left hand cushion 12.11 as well as the right hand cushion 12.12 is filled in a fire-resistant manner with a partitioning compound 41. The partitioning compound 41 is thus visibly present in the area of the opening which is not covered by the plates 28.31 and 28.32. Accordingly, this also applies to the upper area present in the plate 28.33 and in which supply lines 42 are passed through and to the common area present in the lower area of plates 28.32 and 28.33 and in which supply lines 43 are passed through the opening in the building. In these areas, so many panels have likewise been released from the corresponding plates that sufficient space is available to pass through the supply lines 42, 43. The space present between each of the supply lines 42, 43 and the surrounding fire-protection cushions is again filled with partitioning compound 41 as at the supply line 40.

Whereas in wall apertures there are preferably plates 28 on both sides of the wall, plates 28 of this type on ceiling apertures 50 are only necessary on the underside of the latter; the upper side of ceiling apertures is regularly closed by a cover plate 51. This cover plate 51 lies on a stepped portion 52 which is present in a stop profile 53. This stop profile 53, with its upper edge, terminates flush with a floor covering 54. On the stop profile 53 there is a plate 55 projecting into the opening area in which there is an opening through which the shank of a bolt 56 penetrates, while the bolt head rests at the top on the plate 55. With its external thread, the bolt 56 meshes with the internal thread of a nut 57 which is fixed to a case 58 in such a inner opening. This nut 57 sits at the top on a sleeve 59 which is fixed in each corner of the case 58, rectangular in plan view. By adjusting the bolt 56 in the nut 57, the stop profile 53 can be orientated vertically relative to the case 58 in such a way that the stop profile 53, with its upper edge, terminates flush with the floor covering 54 to be incorporated later.

Figure 12:
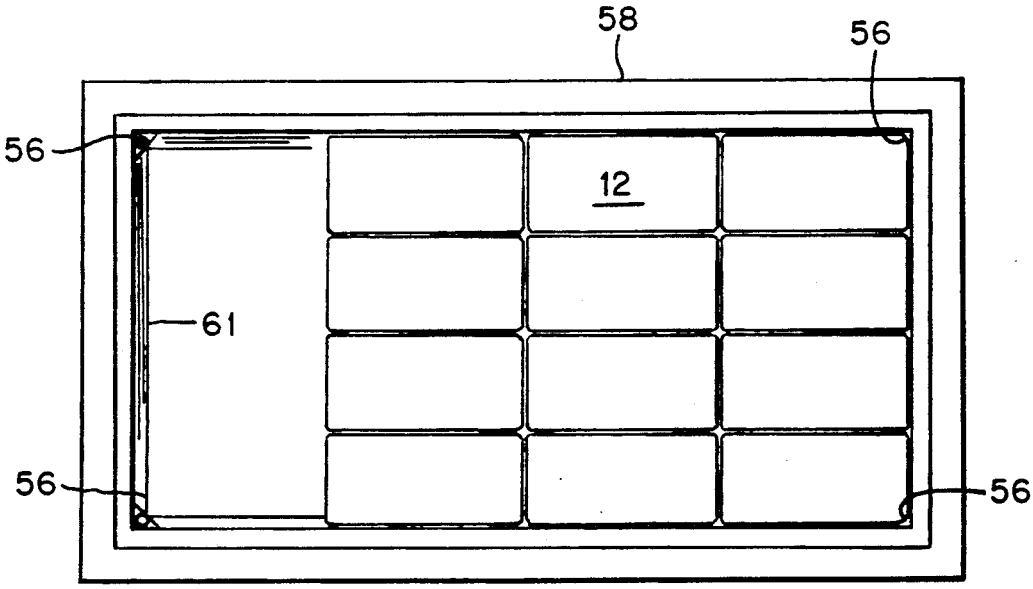
FIG. 12 shows a plan view of the ceiling opening according to FIG. 11.

With one of its legs, an angle profile 60 is fixed to the case 58, while its other leg protrudes into the ceiling area. By means of this angle profile 60, the case 58 is held immovably in the ceiling. On the underside of the case 58 there is a bend 61 which is orientated towards the opening area parallel to the bottom edge of the ceiling. Plates 28 are screwed to the underside of this bend 61. These plates 28 thus cover from below the cushions 12 present in the aperture 50. In the ceiling aperture 50—just as in wall apertures—these cushions can be present in the aperture with their longer edge in the longitudinal direction of the aperture—as shown in FIG.12—or in the transverse direction.

The sleeve 59 present in each corner of the case 58 is so small in cross-section that it does not hinder the installation of a cushion in this corner. Facultatively, it is, also possible to solidly fill the corner area with a so-called packing cushion or with an accurately adapted cushion.

I claim:

1. Fire-protection cushion for closing an opening in structural walls or ceilings defining a fire section comprising an outer envelope of non-combustible textile glass material;

a filling of non-combustible mineral wool;

said filling comprising a single body in the shape of a parallelepiped;

said single body comprising non-compressible mineral wool to which very small proportions of organic bonding agents are added;

said outer envelope surrounded by a further envelope of non-combustible textile glass material; and said outer envelope and said further envelope and said filling designed to be non-deformable under the effect of fire.

2. Fire-protection cushion according to claim 1, wherein the edges of said body are approximately between 5 cm and 50 cm long.

3. Fire-protection cushion according to claim 1, wherein each of said envelopes has seams made of threads; and wherein said threads of said seams of said envelopes are made 100 percent of non-combustible textile glass material.

4. A method for closing an opening in structural walls or ceilings defining a fire section with fire-protection cushions comprising the steps of:

building said structural walls or ceilings with said opening;

inserting said fire-protection cushions into said opening of said structural walls or ceilings during building said structural walls or ceilings with said opening, whereby said fire-protection cushions, are removable from said opening; and said fire-protection cushion comprising;

an outer envelope of non-combustible textile glass material;

a filling of non-combustible mineral wool;

said filling comprising a single body in the shape of a parallelepiped;

said single body comprising non-compressible mineral wool to which very small proportions of organic bonding agents are added;

said outer envelope surrounded by a further envelope of non-combustible textile glass material; and said outer envelope and said further envelope and said filling designed to be non-deformable under the effect of fire.

5. A method for closing an opening in structural walls or ceilings defining a fire section with fire-protection cushions comprising the steps of:

building said structural walls or ceilings with said opening;

inserting said fire-protection cushions into said opening of said structural walls or ceilings whereby said fire-protection cushions are removable from said opening; and said fire-protection cushion comprising;

an outer envelope of non-combustible textile glass material;

a filling of non-combustible mineral wool;

said filling comprising a single body in the shape of a parallelepiped;

said single body comprising non-compressible mineral wool to which very small proportions of organic bonding agents are added;

said outer envelope surrounded by a further envelope of non-combustible textile glass material; and said outer envelope and said further envelope and said filling designed to be non-deformable under the effect of fire.

* * * * *